US010984933B2

(12) United States Patent
Rowe

(10) Patent No.: US 10,984,933 B2
(45) Date of Patent: Apr. 20, 2021

(54) SUPERPARAMAGNETIC IRON COBALT TERNARY ALLOY AND SILICA NANOPARTICLES OF HIGH MAGNETIC SATURATION AND A MAGNETIC CORE CONTAINING THE NANOPARTICLES

(71) Applicant: Toyota Motor Engineering & Manufacturing North America, Inc., Erlanger, KY (US)

(72) Inventor: Michael Paul Rowe, Pinckney, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 222 days.

(21) Appl. No.: 13/921,878

(22) Filed: Jun. 19, 2013

(65) Prior Publication Data

US 2014/0375403 A1 Dec. 25, 2014

(51) Int. Cl.

| | |
|---|---|
| ***H01F 1/36*** | (2006.01) |
| ***H01F 41/02*** | (2006.01) |
| ***H01F 3/08*** | (2006.01) |
| ***H01F 1/00*** | (2006.01) |

(52) U.S. Cl.

CPC ..... *H01F 3/08* (2013.01); *H01F 1/0054* (2013.01); *H01F 41/0246* (2013.01)

(58) Field of Classification Search

None

See application file for complete search history.

(56) References Cited

U.S. PATENT DOCUMENTS

| | | | | |
|---|---|---|---|---|
| 4,601,765 | A | 7/1986 | Soileau et al. | |
| 5,451,245 | A | 9/1995 | Nomura et al. | |
| 5,512,317 | A | 4/1996 | Blagev | |
| 5,763,108 | A * | 6/1998 | Chang et al. | 428/812 |
| 6,051,324 | A * | 4/2000 | Moorhead et al. | 428/552 |
| 6,551,659 | B1 * | 4/2003 | Clough | C23C 4/134 427/212 |
| 6,972,046 | B2 | 12/2005 | Sun et al. | |
| 7,001,499 | B2 | 2/2006 | Chen et al. | |
| 7,678,174 | B2 | 3/2010 | Tokuoka et al. | |
| 8,273,407 | B2 | 9/2012 | Bergendahl et al. | |
| 2002/0189718 | A1 * | 12/2002 | Yoshizawa | 148/313 |
| 2003/0077448 | A1 | 4/2003 | Ueta et al. | |
| 2006/0283290 | A1 | 12/2006 | Hattori et al. | |
| 2008/0087314 | A1 * | 4/2008 | Xiao et al. | 136/201 |

(Continued)

FOREIGN PATENT DOCUMENTS

JP 3153838 7/1991

OTHER PUBLICATIONS

U.S. Appl. No. 13/900,860, filed May 23, 2013, Rowe.

(Continued)

*Primary Examiner* — Ronak C Patel

(74) *Attorney, Agent, or Firm* — Oblon, McClelland, Maier & Neustadt, L.L.P.

(57) ABSTRACT

Thermally annealed superparamagnetic core shell nanoparticles of an iron-cobalt ternary alloy core and a silicon dioxide shell having high magnetic saturation are provided. A magnetic core of high magnetic moment obtained by compression sintering the thermally annealed superparamagnetic core shell nanoparticles is also provided. The magnetic core has little core loss due to hysteresis or eddy current flow.

12 Claims, 2 Drawing Sheets

(56) References Cited

U.S. PATENT DOCUMENTS

| | | | | |
|---|---|---|---|---|
| 2010/0054981 | A1 | 3/2010 | Liu | |
| 2010/0056366 | A1* | 3/2010 | Lee | 502/300 |
| 2010/0092384 | A1* | 4/2010 | Bumb et al. | 424/1.29 |
| 2010/0258759 | A1 | 10/2010 | Archer et al. | |
| 2011/0098453 | A1* | 4/2011 | Hyeon et al. | 530/415 |
| 2011/0104476 | A1 | 5/2011 | Toyoda et al. | |
| 2011/0129763 | A1* | 6/2011 | Lee et al. | 429/532 |
| 2012/0106111 | A1 | 5/2012 | Mazzochette et al. | |

OTHER PUBLICATIONS

U.S. Appl. No. 13/565,250, filed Aug. 2, 2012, Rowe.
U.S. Appl. No. 13/558,397, filed Jul. 26, 2012, Rowe.
U.S. Appl. No. 13/529,316, filed Jun. 21, 2012, Rowe.
U.S. Appl. No. 13/942,116, filed Jul. 15, 2013, Rowe, et al.
U.S. Appl. No. 14/521,063, filed Oct. 22, 2014, Rowe, et al.
Chih Hao Yu, et al., "Immobilization of BSA on Silica-Coated Magnetic Iron Oxide Nanoparticle" J. Phys. Chem. C, vol. 113, No. 2, (p. 537-543), 2009.
Shin Tajima, et al., "Properties of High-Density Magnetic Composite Fabricated From Iron Powder Coated with a New Type Phosphate Insulator" IEEE Transactions on Magnetics, vol. 41, No. 10, (p. 3280-3282), Oct. 2005.
Shouheng Sun, et al., "Size-Controlled Synthesis of Magnetite Nanoparticles" J. Am. Chem. Soc., vol. 124, No. 28, (p. 8204-8205), 2002.
A Bumb, et al., "Synthesis and Characterization of Ultra-Small Superparamagnetic Iron Oxide Nanoparticles Thinly Coated with Silica" Nanotechnology 19 (2008) 335601 (6 pg.)
U.S. Appl. No. 14/270,619, filed May 6, 2014, Rowe, et al.
U.S. Appl. No. 14/270,752, filed May 6, 2014, Rowe, et al.
U.S. Appl. No. 14/252,036, filed Apr. 14, 2014, Rowe, et al.
U.S. Appl. No. 14/296,917, filed Jun. 5, 2014, Rowe, et al.

* cited by examiner

A - Single domain particles
B - Multi domain particles
C - Range of superparamagnetism

SUPERPARAMAGNETIC IRON COBALT TERNARY ALLOY AND SILICA NANOPARTICLES OF HIGH MAGNETIC SATURATION AND A MAGNETIC CORE CONTAINING THE NANOPARTICLES

BACKGROUND OF THE INVENTION

Field of the Invention

The present invention relates to superparamagnetic core shell nanoparticles having an iron cobalt ternary alloy core and a silica shell which have high magnetic saturation and a magnetic core produced with these high magnetic saturation nanoparticles. The core of the present invention is suitable for utility in power generation parts such as stators, rotors, armatures and actuators or any device whose function is dependent upon an efficient magnetic core, i.e., a magnetic core having a high magnetic moment, minimal magnetic hysteresis and no or little eddy current formation.

Discussion of the Background

Many electronic devices rely on magnetic cores as a method of transferring a magnetic field. Due to inefficiency caused by core loss, a portion of this power is lost, typically as waste heat. A core's magnetic properties have the ability to greatly concentrate and enhance magnetic fields. Thus, improving and implementing core materials with low loss as well as high magnetic permeability would enormously enhance the efficiency of the device. With increased interest in environmentally-conscious devices, the implementation of improved magnetic core material across millions and millions of devices that require them (all computers, TVs, cell phones, vehicle power electronics, etc.) could produce significant benefits for global energy conservation.

Magnetic materials generally fall into two classes which are designated as magnetically hard substances which may be permanently magnetized or soft magnetic materials which may be reversed in magnetism at low applied fields. It is important in soft magnetic materials that energy loss, normally referenced as "core loss" is kept to a minimum whereas in hard magnetic materials it is preferred to resist changes in magnetization. High core losses are therefore characteristic of permanent magnetic materials and are undesirable in soft magnetic materials.

Soft magnetic core components are frequently used in electrical/magnetic conversion devices such as motors, generators and transformers and alternators, particularly those found in automobile engines. The most important characteristics of soft magnetic core components are their maximum induction, magnetic permeability, and core loss characteristics. When a magnetic material is exposed to a rapidly varying magnetic field, a resultant energy loss in the core material occurs. These core losses are commonly divided into two principle contributing phenomena: hysteresis and eddy current losses. Hysteresis loss results from the expenditure of energy to overcome the retained magnetic forces within the core component. Eddy current loss, the other source of core loss, refers to circular currents setup within the magnetic core due to the applied magnetic field, as explained by Faraday's Law. Eddy current losses are brought about by the production of induced currents in the core component due to the changing flux caused by alternating current (AC) conditions. These circular currents create a magnetic field anti-parallel to the applied field, decreasing the overall field within the core. In order to reduce eddy current formation, materials with low electrical conductivities are used.

Thus magnetic core inefficiency is measured in terms of core loss. To improve core loss, the magnetic core must demonstrate a reduced measure of magnetic hysteresis as well as lowered eddy current formation. Applicants have described a magnetic core of significantly reduced magnetic hysteresis and low eddy current formation obtained by sintering superparamagnetic core shell nanoparticles having an iron cobalt ternary alloy core and silica shell into a monolithic core structure in U.S. application Ser. No. 13/565,250, filed Aug. 8, 2012, the disclosure of which is incorporated herein by reference in its entirety.

These nanoparticles, while offering exceptionally low to zero coercivities $H_C$), typically have decreased magnetic saturations ($M_S$). One possible reason for this lower magnetic saturation is canted spin alignment due to defects near the surfaces of these nanoparticles. It is believed that defects near the surface (be they crystalline or spin orientation defects) become kinetically trapped during the synthesis of the nanoparticles. Such atomic scale disorder lowers the $M_S$ and limits the maximum magnetic flux capacity of a magnetic device such as an inductor.

Thus, the magnetic saturation ($M_s$) is a second important magnetic property of a material. Magnetic saturation is empirically measured and is representative of the total magnetic moment of a material sample. A low $M_s$ can limit the application utility of a material and therefore, a high $M_s$ is an important property to be an effective and useful magnetic material.

The magnetic saturation is influenced by a number of factors, which includes material composition, crystallinity and the stress-strain exerted on the material during production.

The use of powdered magnetic materials allows the manufacture of magnetic parts having a wide variety of shapes and sizes. Conventionally, however, these materials made from consolidated powdered magnetic materials have been limited to being used in applications involving direct currents. Direct current applications, unlike alternating current applications, do not require that the magnetic particles be insulated from one another in order to reduce eddy currents.

Conventionally, magnetic device parts are constructed from powders by compaction of the powders to a defined shape and then sintering the compact at temperatures of 600° C. or higher. Sintering the part following compaction, is necessary to achieve satisfactory mechanical properties in the part by providing particle to particle bonding and hence strength. However, sintering may cause volume changes and results in a manufacturing process with poor dimensional control.

In other conventional processes designed to prepare parts having minimum eddy current losses, the magnetic particles are coated with thermoplastic materials before pressing. The plastic is provided to act as a barrier between the particles to reduce induced eddy current losses. However, in addition to the relatively high cost of such coatings, the plastic has poor mechanical strength and as a result, parts made using plastic-coated particles have relatively low mechanical strength. Additionally, many of these plastic-coated powders require a high level of binder when pressed. This results in decreased density of the pressed core part and, consequently, a decrease in magnetic permeability and lower induction. Additionally, and significantly, such plastic coatings typically degrade at temperatures of 150-200° C. Accordingly, magnetic parts made in such manner are generally limited to utility in low stress applications for which dimensional control is not critical.

Thus, there remains a need for magnetic powders to produce soft magnetic parts, having increased green strength, high temperature tolerance, and good mechanical properties, which parts have minimal or essentially no core loss and high magnetic moment.

Conventionally, ferromagnetic powders have been employed for the production of soft magnetic core devices. Such powders are generally in a size range measured in microns and are obtained by a mechanical milling diminution of a bulk material. Superparamagnetic nanoparticle materials having particle size of less than 100 nm have found utility for magnetic record imaging, as probes for medical imaging and have been applied for targeted delivery of therapeutic agents. However, the utilization of superparamagnetic powders for production of core magnetic parts has until now, been limited.

For example, Toyoda et al. (U.S. 2011/0104476) describe a soft magnetic material of iron or an iron alloy particle having a grain size of from 5 to 400 μm which is provided with an oxide insulative coating including silicon oxide. The coated particles are mixed with an organic substance which is a non-thermoplastic resin and at least one of a thermoplastic resin and a higher fatty acid. The content of the organic substance in the mixed material is from 0.001 to 0.2% by mass. The mixed material is compression molded and then subjected to a heat treatment at a temperature between the glass transition temperature and the thermal decomposition temperature of the non-thermoplastic resin. The molded and heat treated structure is indicated to be useful for electric and electronic components such as a motor core or a transformer core.

Moorhead et al. (U.S. Pat. No. 6,051,324) describes a composite nanostructure obtained by compaction of coated metal particles. The metal particles are of approximately 325 mesh and include as metal materials, alloys of iron, cobalt, vanadium and chromium. The alloy particles are coated with an inorganic material such as a ceramic or glass. Examples of the coating material include $Al_2O_3$ and $SiO_2$. This reference is silent with respect to magnetic properties of the compacted composite with regard to thermal treatment history.

Hattori et al. (U.S. 2006/0283290) describe silica coated, nitrided iron particles having an average particle diameter of 5 to 25 nm. The particles are "substantially spherical" and are useful for magnetic layers such as a magnetic recording medium.

Chen et al. (U.S. Pat. No. 7,001,499) describes nickel-iron alloy thin films formed by electroplating at low temperature and annealing. The thin films have high saturation flux densities and are useful as magnetic write heads. The electroplated film contains from 63 to 81% by weight iron and after formation the film is annealed at about 245° C. in an external magnetic field aligned with the electroplated easy axis. The annealing is indicated to be critical to reduction of the coercivity of the electroplated layer and to increase the magnetic moment.

Ueta et al. (U.S. 2003/0077448) describes a ferromagnetic raw metal powder (primarily iron) having a coating of various oxide materials including silicon. Claim 1 provides a ferromagnetic powder which is surface coated with a silicone resin and a pigment. The coated particle has a diameter on the order of 100 microns. Warm pressing of the powder to produce a core is described as well as annealing of a core at elevated temperature.

Tokuoka et al. (U.S. Pat. No. 7,678,174) describe an iron based powder particle having an iron or iron alloy core and an oxide type insulating coating, including silicon oxide. An ester wax is also added to the particle surface. The coated powder particles are on the order of 200 microns in size as described in Example 1. The lubricated powder is pressure molded to form a molded body and the molded body heat treated.

Blagev (U.S. Pat. No. 5,512,317) describes an acicular magnetic iron oxide particle having a magnetic iron oxide core and a shell containing a silicate compound and cobalt (II) or iron (II) compound as a dopant. The doped acicular particles have a length typically of about 0.15 to 0.50 μm and are employed in magnetic recording media.

Morikazu et al (JP03153838) (Abstract only) describes a sintered alloy molding which is obtained by surface treating a Fe/Co.V alloy powder with alkoxy silane type agent. Upon sintering, a Fe/Co/V/Si alloy is formed. The abstract provides no description relating magnetic properties of the compacted composite to thermal treatment history.

Nomura et. al. (U.S. Pat. No. 5,451,245) describes acicular magnetic particles having a largest dimension of about 0.3 μm which are suitable for magnetic recording media. Hydrated iron oxide particles are first coated with an aluminum or zirconium compound, then heated to form a hematite particle. This formed particle is then coated a second time with an aluminum compound followed by a reduction treatment. Silicon compounds may be included in either coating to enhance the properties of the particle.

Soileau et al. (U.S. Pat. No. 4,601,765) describes a core obtained by compaction of iron powder which has been coated with an alkali metal silicate and then a silicone resin polymer. The iron particles to which the coating is applied have a mean particle size of 0.002 to 0.006 inches. The core is prepared by compaction of the powder at greater than 25 tons per square inch and then annealing the pressed component.

Yu et al. (J. Phys. Chem. C 2009, 113, 537-543) describes the preparation of magnetic iron oxide nanoparticles encapsulated in a silica shell. Utility of the particles as magnetic binding agents for proteins is studied.

Tajima et al. (IEEE Transactions on Magnetics, Vol. 41, No. 10, October, 2005) describes a method to produce a powder magnetic core described as warm compaction using die wall lubrication (WC-DWL). According to the method an iron powder coated with a phosphate insulator was compacted under a pressure of 1176 MPa at a temperature of 423° K to produce a core type structure.

Sun et al. (J. Am. Chem. Soc., 2002, 124, 8204-8205) describes a method to produce monodisperse magnetite nanoparticles which can be employed as seeds to grow larger nanoparticles of up to 20 nm in size.

Bumb et al. (Nanotechnology, 19, 2008, 335601) describes synthesis of superparamagnetic iron oxide nanoparticles of 10-40 nm encapsulated in a silica coating layer of approximately 2 nm. Utility in power transformers is referenced, but no description of preparation of core structures is provided.

Mazzochette et al. (U.S. 2012/0106111) describes a magnetic anisotropic conductive adhesive composition which contains an adhesive binder and a conductive nano-material filler. The adhesive binder is a UV, radiation or heat curable resin such as epoxy, acrylate or urethane. The conductive filler particles may be paramagnetic or ferromagnetic and include aluminum, platinum, chromium, manganese, iron and alloys of these. The particles may be coated with a conductive metal such as gold, silver, copper or nickel. In application, the adhesive is applied to the substrate structure, exposed to a magnetic field to align the particles and the resin cured while the field is applied.

Archer et al. (U.S. 2010/0258759) describes metal oxide nanostructures which may be hollow or contain an inner core particle. In one embodiment, this reference describes coating $\alpha$-$Fe_2O_3$ spindle particles with a $SiO_2$ layer, then coating those particles with a $SnO_2$ layer. Porous double-shelled nano-cocoons were prepared by application of two $SnO_2$ layers, annealing the particles at 550 to 600° C. and then dissolving the $SiO_2$ from the particle. The magnetic properties of the particles are mentioned within a general description.

Liu (U.S. 2010/0054981) describes bulk nanocomposite materials containing both hard phase nanoparticle magnetic material and soft phase nanoparticle magnetic material. The two components are mixed and warm compacted to form the bulk material. Prior to the warm compaction, the materials may be heated annealed or ball milled. Liu describes that the density of the compacted bulk material increases with increasing compaction temperature and pressure. The soft phase materials include FeO, $Fe_2O_3$, Co Fe, Ni CoFe, NiFe and the hard phase materials include FePt, CoPt, SmCo-based alloys and rare earth-FeB-based alloys. Various methods to prepare magnetic nanoparticles are described, including a "polyol Process." In Example 1, a bulk nanocomposite of FePt and $Fe_3O_4$ is prepared and tested for properties. A phase transition with increasing temperature is confirmed by showing corresponding changes in magnetic properties such as saturation magnetization and coercivity.

Ueta et al. (U.S. 2003/0077448) describe preparation of an iron-based powder having an insulate coating of multiple layers. The iron based powder is first painted with a solvent based silicone resin composition and a pigment. The solvent is dried away and the silicone resin cured. An outer layer of a metal oxide, nitride or carbide is then applied. The coated powder is then formed into a core, optionally with annealing to remove the strain due to pressing. Ueta suggests that the annealing causes thermal degradation of the silicone to form a silica layer including the pigment on the iron base particle.

Bergendahl et al. (U.S. Pat. No. 8,273,407) describe a method to form a thin film of magnetic nanoparticles on a substrate such as a semiconductor wafer. The film contains aggregates of magnetic nanoparticle clusters which are separated from one another by a distance of from 1 to 50 nanometers. Clusters of the magnetic nanoparticles are first applied to the substrate and the clusters are thermally annealed or irradiated with UV or laser to form aggregates. The magnetic nanoparticles may be Fe, Ni, Co, NiCo, FeZn, borides of these, ferrites, rare earth metals or alloy combinations. An insulator coating is placed over the magnetic aggregates. The insulator material may be $SiO_2$, $Si_3N_4$, $Al_2O_3$, ceramics, polymers, ferrites, epoxies, Teflon or silicones.

Sun et al. (U.S. Pat. No. 6,972,046) describes a process of forming a hard-soft phase, exchange-coupled magnetic nanocomposite. According to the method solvent dispersions of hard phase nanoparticles and soft phase nanoparticles are mixed, and the solvent removed to obtain self-assembled structures. Coatings of the nanoparticles are removed in an annealing treatment to form a compact nanoparticle self-assembly wherein the nanoparticles are exchange coupled. The soft magnetic materials include Co, Fe, Ni, CoFe, NiFe, $Fe_2O_3$ and other oxides. The hard magnetic materials include CoPt, FePt, SmCo based alloys and rare earth-FeB-based alloys. The nanocomposites may be compacted to form a high density nanocomposite that is devoid of spaces between the magnetic materials in order to obtain a bulk permanent magnet. Sun et al. describe a direct relationship of coercivity and annealing temperature up to a temperature of agglomeration of the nanoparticles.

None of the above references disclose or suggest that thermal annealing of core shell nanoparticles having an iron cobalt ternary alloy core and silica shell results in a significant increase in magnetic saturation. Likewise, none of the above references disclose or suggest a monolithic magnetic core constructed by heated compression of thermally annealed nanoparticular iron cobalt ternary alloy encapsulated in a silicon dioxide coating shell, wherein the particles are directly compacted without addition of lubricant or other material to facilitate particle adherence.

SUMMARY OF THE INVENTION

An object of the present invention is to provide a magnetic powder to produce soft magnetic parts, having increased green strength, high temperature tolerance, good mechanical properties, minimal or essentially no core loss and high magnetic saturation.

A second object of the invention is to provide a magnetic core having a high total magnetic moment and little or no core loss.

A third object is to provide a method to produce a magnetic core or shaped core part having a high total magnetic moment and little or no core loss.

These and other objects have been achieved according to the present invention, the first embodiment of which provides a thermally annealed superparamagnetic core shell nanoparticle, comprising: a superparamagnetic core of an iron cobalt ternary alloy; and a shell of a silicon oxide directly coating the core; wherein a diameter of the core is 200 nm or less, and the core shell particle is obtained by a process comprising: wet chemical precipitation of the core nanoparticle; coating of the core nanoparticle with a silicon dioxide shell to obtain a thermally untreated core shell nanoparticle having a magnetic saturation ($M_s$); and thermal annealing of the untreated core shell nanoparticle to obtain the thermally annealed superparamagnetic core shell nanoparticle having a magnetic saturation ($^{TA}M_s$); wherein $^{TA}M_s$ is equal to or greater than 1.25 $M_s$.

In a second embodiment, the present invention provides a magnetic core, comprising: a plurality of thermally annealed superparamagnetic core shell nanoparticles, the nanoparticles each comprising: a superparamagnetic core of an iron cobalt ternary alloy; and a shell of a silicon oxide directly coating the core; wherein a diameter of the iron cobalt ternary alloy core is 200 nm or less, the core shell nanoparticle is obtained by a process comprising: wet chemical precipitation of the core nanoparticle; coating of the core nanoparticle with a silicon dioxide shell to obtain a thermally untreated core shell nanoparticle having a magnetic saturation ($M_s$); and thermal annealing of the untreated core shell nanoparticle to obtain the thermally annealed superparamagnetic core shell nanoparticle having a magnetic saturation ($^{TA}M_s$); wherein $^{TA}M_s$ is equal to or greater than 1.25 $M_s$ and wherein the magnetic core is a monolithic structure of the thermally annealed superparamagnetic core grains of iron cobalt ternary alloy directly bonded by the silicon oxide shells.

In a specific embodiment of the present invention the iron cobalt ternary alloy is an iron cobalt vanadium alloy.

In a further embodiment, the present invention provides a method to prepare a monolithic magnetic core, the magnetic core comprising the thermally annealed superparamagnetic core shell particles of any of the previous embodiments.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE INVENTION

The inventors have discovered that a thermal annealing treatment of the superparamagnetic core shell nanoparticles following preparation of the core shell structure results in the production of a magnetic material having markedly different magnetic properties in comparison to the similarly prepared materials which are not annealed. Thus the inventors have surprisingly discovered that by producing superparamagnetic iron cobalt ternary alloy nanoparticles that are encapsulated in silica shells, thermally annealing the nanoparticles under specific conditions related to the particle size and composition and then compacting and sintering these nanoparticles into a monolithic nanomaterial core, the core obtained, in addition to having zero (or very low) hysteresis and very low eddy current formation has a high magnetic moment.

Thus, the first embodiment of the present invention provides a thermally annealed superparamagnetic core shell nanoparticle, comprising: a superparamagnetic core of an iron cobalt ternary alloy; and a shell of a silicon oxide directly coating the core; wherein a diameter of the iron cobalt ternary alloy core is 200 nm or less, preferably 50 nm or less, more preferably 3 to 35 nm and most preferably 5 to 15 nm. The core shell particle may be obtained by a process comprising: wet chemical precipitation of the core nanoparticle; coating of the core nanoparticle with a silicon dioxide shell to obtain a thermally untreated core shell nanoparticle having a magnetic saturation ($M_s$); and thermal annealing of the untreated core shell nanoparticle to obtain the thermally annealed superparamagnetic core shell nanoparticle having a magnetic saturation ($^{TA}M_s$); wherein $^{TA}M_s$ is equal to or greater than 1.25 $M_s$.

The third component of the iron cobalt ternary alloy is selected from the group consisting of scandium, titanium, vanadium, chromium, manganese, nickel, copper and zinc.

In a highly preferred embodiment, according to the present invention, the iron cobalt ternary alloy is an iron cobalt vanadium alloy.

In another highly preferred embodiment according to the present invention, the iron cobalt ternary alloy is an iron cobalt chromium alloy.

According to the invention, the iron cobalt ternary alloy nanoparticle grains are of or approaching the size of the single particle magnetic domain of the iron cobalt ternary alloy and thus are superparamagnetic. While not being constrained to theory, the inventors believe control of grain size to approximately that of the particle magnetic domain is a factor which contributes to the reduced hysteresis of a magnetic core according to the present invention. Moreover, the presence of insulating silica shells about the core grains is a factor which contributes to the low eddy current formation of a magnetic core according to the present invention.

Figure 2:
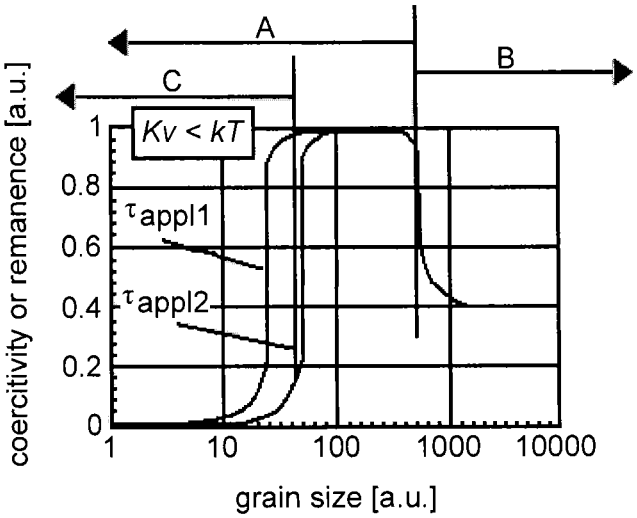
FIG. 2 shows a generalized relationship of particle size and range of superparamagnetism.

It is conventionally known that the range of particle size for which single domain particles exhibit superparamagnetism has an upper boundary characteristic of the particle chemical constitution. This phenomenon is shown in FIG. 2 which is reproduced from Nanomaterials An Introduction to Synthesis, Properties and Applications by Dieter Vollath (page 112) Wiley-VCH. According to FIG. 2, above a certain size range, nanoparticles will exhibit a measurement time dependency characteristic of ferromagnetic behavior. To avoid this time dependency nanoparticles of a size within the range of superparamagnetism must be prepared and that size maintained during further processing.

The inventors have discovered that by a process of rapid thermal annealing of the iron cobalt ternary alloy core shell nanoparticles according to the invention the $M_S$ is increased without significantly increasing the magnetic coercivity ($H_c$). Although not being limited by theory, the inventor believes that in the material composition of these annealed nanoparticles that exhibit an increased $M_s$ the magnetic moment of the total nanoparticles is organized and produces a markedly different magnetic material property in comparison to the as synthesized material.

The inventors believe that thermal annealing of magnetic materials allows for the relaxation of trapped-in defects formed in synthesis and thus, an improvement in magnetic properties (i.e. $M_S$). However, at increased temperatures two conflicting processes are occurring within the nanoparticles. On one hand, the alignment of the particle crystal structure leading to a more pure crystallinity takes place; while at the same time the nanoparticles are prone to coalesce and grow in crystal size. These two phenomena have opposite effect on the magnetic properties of the nanoparticle and therefore, the annealing procedure must be designed to maximize perfection of crystallinity while at the same time minimizing nanoparticle growth. Thus, as thermal annealing allows for the relaxation of crystal structures, it may also result in particle-particle growth despite the encapsulating silica shells. High specific surface area materials such as the superparamagnetic nanoparticles (SPNPs) according to the invention are especially prone to particle growth as they are thermodynamically-driven to reduce their surface energy. Such particle growth is particularly detrimental for application as a core material, since particles that are too large no longer exhibit superparamagnetic (single domain) properties, and will exhibit an unacceptably large $H_c$.

To avoid such particle growth the inventors have discovered that with iron cobalt ternary alloy nanoparticles, rapidly annealing the core/shell SPNPs kinetically limits the amount of particle growth.

Nanoparticles of Fe—Co—V/$SiO_2$ may be synthesized by the ethanolic reaction of sodium borohydride with iron dichloride, cobalt dichloride and vanadium trichloride in a solution of sodium hydroxide and tetraoctylammonium bromide. The obtained nanoparticles may be treated with tetraethyl orthosilicate, in water ethanol mixture using triethylamine as the base-catalyst, to form silica shells. These particles may then be purified using an aqueous ethanol rinse.

Annealing temperatures may be varied between 150° C. and 600° C., while annealing times (at temperature) may be from 1 second to 3.5 minutes. In one embodiment the sample is heated at 200° C. for 20 seconds.

A Quantum Design VersaLab™ vibrating sample magnetometer (VSM) may be used to obtain the M-H hysteresis curves for the nanopowders. VSM analysis may be conducted at 300 K in a low pressure (~40 torr) atmosphere. The hysteresis curve for the sample annealed at 200° C. for 20 seconds is compared to the same material prior to annealing in FIG. 1.

The inventor has discovered that actual optimal annealing time and temperatures may vary with lot to lot produced nanoparticles, depending on factors such as, for example, actual particle size, particle size distribution and chemical composition of the nanoparticles. Thus the optimum time at a given temperature for a given nanoparticle batch may be determined by the procedures described above.

In general, for Fe—Co ternary alloy nanoparticles prepared as described above, annealing times of about 3 to 180 seconds, preferably, 10 to 50 seconds at annealing temperatures of about 180 to 550° C. are effective according to the invention. These values include all sub-ranges and specific temperatures and times within these ranges. In a preferred embodiment the time of annealing at 200° C. is from 15 to 30 seconds.

Figure 1:
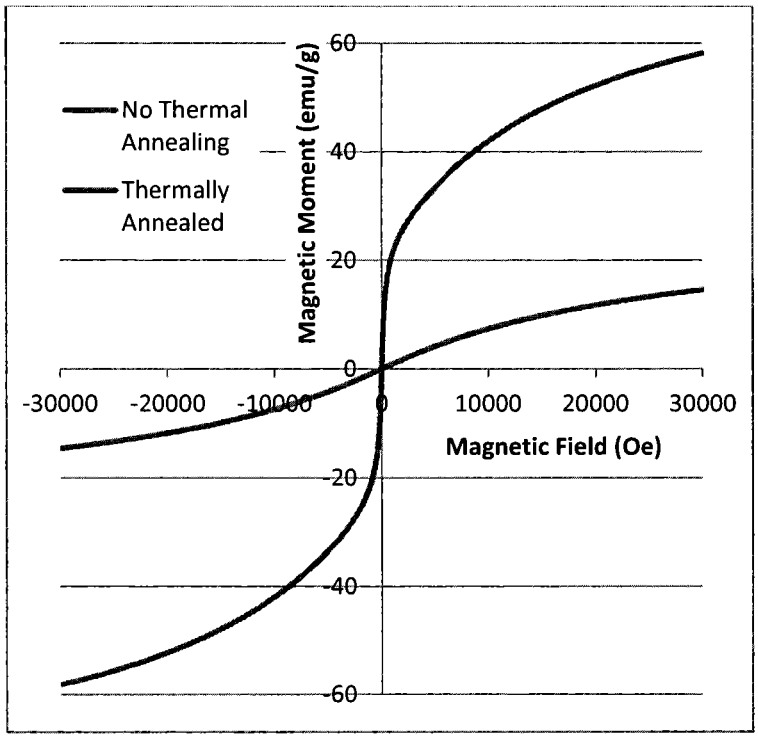
FIG. 1 shows the hysteresis curves for a sample annealed according to an embodiment of the invention in comparison to the material before annealing.

Thus, as shown by the data in FIG. 1, magnetic saturation value may be increased by a factor of almost 3 times. Value increases of 15 to 58 emu/g may be obtained upon annealing according to the invention. Correspondingly, coercivity values were found to not change appreciably during annealing under the conditions according to the invention, indicating the particles remain in their single-domain nano-scale state.

In another embodiment, the present invention includes a magnetic core, comprising: the thermally annealed iron-cobalt ternary alloy core shell nanoparticles having a particle size of less than 200 nm, preferably less than 50 nm; wherein the core is an iron-cobalt ternary alloy and the shell is a silicon oxide and the magnetic core is a monolithic structure of superparamagnetic core grains of iron-cobalt ternary alloy directly bonded by the silicon oxide shells. Preferably the particle size is from 3 to 35 nm and most preferably from 5 to 15 nm. These ranges include all subranges and values there between.

The core according to the present invention is monolithic, having the space between the thermally annealed iron-cobalt ternary alloy nanoparticle grains occupied by the silicon oxide. Preferably at least 97% of the space between the grains, preferably 98% and most preferably 100% of the space is silicon oxide and further most preferably the silicon oxide is silicon dioxide. According to the present invention neither any binder nor any resin is contained in the matrix of the monolithic core.

The monolithic core according to the present invention is obtained by a process comprising sintering a powder of the thermally annealed superparamagnetic core shell particles having a particle size of less than 200 nm under pressure under flow of an inert gas to obtain a monolithic structure; wherein the core of the core shell particle consists of superparamagnetic iron-cobalt ternary alloy, preferably iron-cobalt-vanadium, and the shell consists of silicon dioxide. Because a magnetic material is only superparamagnetic when the grain size is near or below the magnetic domain size, the nanoparticle core must be maintained as small as possible, or the sample will become ferromagnetic, and express magnetic hysteresis. Therefore, the most mild and gentle sintering conditions that still yield a monolithic sample that is robust enough to be machined into a toroid are desired, because more aggressive sintering conditions will promote unwanted grain growth and potentially, loss of superparamagnetic performance.

The magnetic core as described herein may be employed as a component in an electrical/magnetic conversion device, as known to one of ordinary skill in the art. In particular the magnetic core according to the present invention may be a component of a vehicle part such as a motor, a generator, a transformer, an inductor and an alternator, where high magnetic moment is advantageous.

Having generally described this invention, a further understanding can be obtained by reference to certain specific examples which are provided herein for purposes of illustration only and are not intended to be limiting unless otherwise specified. Skilled artisans will recognize the utility of the devices of the present invention as a battery as well as the general utility of the electrolyte system described herein.

EXAMPLE

Core/Shell Iron-Cobalt-Vanadium/Silica-Coated Nanoparticles

The nanoparticles were synthesized as follows:

Sodium borohydride (2.45 g) was dissolved in ethanol (90 mL). This sodium borohydride solution was added to a stirring solution of ethanol (105 mL) containing:

sodium hydroxide (0.102 g), tetraoctyalammonium bromide (2.362 g), iron dichloride tetrahydrate (2.181 g), cobalt dichloride hexahydrate (2.410 g), and vanadium trichloride (0.0683 g).

The reaction was allowed to stir for 10 minutes to insure full reaction had taken place.

It was then washed with a solution of ethanol and water (30/70 by volume, respectively) to remove the reaction byproducts.

The nanoparticles were dispersed in a solution of water (126 mL) and triethylamine (3.3 mL) This suspension was mixed thoroughly.

Tetraethyl orthosilicate (0.200 mL) dissolved in ethanol (78 mL) was then added and allowed to react for 20 mins.

The product was washed with again with the solution of ethanol and water (30/70) and then pure ethanol to remove any reaction byproducts.

These nanoparticles were thermally annealed at 200° C. for 20 seconds, which produced a nanoparticle material that was still superparamagnetic, but with substantially elevated magnetic saturation. (FIG. 1)

Finally, this improved superparamagnetic nanoparticle was hot press sintered to form a compacted nanocomposite which was then fabricated into a magnetic core for use in devices such as transformers and inductors.

The product of the hot press sintering was a disc. The size of the disk is dependent upon the size of punch and die set used. As described here but not limiting the dimensions of those stated, discs were produced that were 9 mm in diameter and 2.5 mm thick. The disc was converted to a toroid through conventional machining techniques. The fabricated toroid was hand-wound with copper enameled wire to produce an inductor.

The invention claimed is:

1. A magnetic core, comprising:

superparamagnetic grains of an iron cobalt ternary alloy; and a matrix of silicon dioxide as a shell on to the superparamagnetic grains;

wherein a diameter of the iron cobalt ternary alloy grain is from 3 to 35 nm, the third component of the ternary alloy is a transition metal selected from the group consisting of scandium, titanium, vanadium, chromium, manganese, nickel, copper and zinc, the magnetic core is superparamagnetic, and the magnetic core is a monolithic structure obtained by a process comprising:

wet chemical precipitation of the iron cobalt alloy grain;

coating of the grain with a silicon dioxide shell to obtain a thermally untreated core shell nanoparticle having a magnetic saturation ($M_s$); and thermal annealing of the untreated core shell nanoparticle to obtain the thermally, annealed superparamagnetic core shell nanoparticle having a magnetic saturation ($^{TA}M_s$);

wherein $^{TA}M_s$ is equal to or greater than 1.25 $M_s$ and sintering the thermally annealed core shell nanoparticles under pressure to form the monolithic structure of thermally annealed superparamagnetic core grains of an iron cobalt ternary alloy directly bonded by the silicon dioxide shells, which form a matrix.

2. The magnetic core according to claim 1, wherein the thermal annealing comprises heating the core shell nanoparticle having a magnetic saturation ($M_s$) at a temperature of from 150° C. to 600° C. for from 3 to 180 seconds.

3. The magnetic core according to claim 1, wherein a coercivity value of the thermally untreated core shell nanoparticle ($H_C$) and a coercivity value of the thermally treated core shell nanoparticle ($^{TA}H_C$) are substantially equal.

4. The magnetic core according to claim 1, wherein a space between individual thermally annealed superparamagnetic nano iron cobalt ternary alloy grains is occupied substantially only by the silicon dioxide.

5. The magnetic core according to claim 1, wherein the thermally annealed superparamagnetic core comprises an iron cobalt vanadium alloy.

6. The magnetic core according to claim 1, wherein the thermally annealed superparamagnetic core consists of an iron cobalt vanadium alloy.

7. The magnetic core according to claim 1, wherein at least 97% by volume: of the space between the thermally annealed superparamagnetic core grains of iron cobalt ternary alloy is occupied by silicon dioxide.

8. The magnetic core according to claim 1, wherein the monolithic core comprises no binder and no resin.

9. An electrical/magnetic conversion device, which comprises the magnetic core according to claim 1.

10. A vehicle part comprising the electrical/magnetic conversion device according to claim 9, wherein the part is selected from the group consisting of a motor, a generator, a transformer, an inductor and an alternator.

11. A method to prepare the magnetic core of claim 1, comprising:

wet chemical precipitation of the iron cobalt alloy grain;

coating of the grain with a silicon dioxide shell to obtain a thermally untreated core shell nanoparticle having a magnetic saturation ($M_s$) and thermal annealing of the untreated core shell nanoparticle to obtain the thermally annealed superparamagnetic core shell nanoparticle having a magnetic saturation ($^{TA}M_s$);

wherein $^{TA}M_s$ is equal to or greater than 1.25 $M_s$; and sintering the thermally annealed superparamagnetic core shell nanoparticles under heat and pressure under flow of an inert gas to obtain the monolithic structure.

12. The method according to claim 11, wherein the thermal annealment comprises heating the core shell nanoparticles at a temperature of from 150° C. to 600° C. for from 3 to 180 seconds.

* * * * *